US005142196A

United States Patent [19]

Fox

[11] Patent Number: 5,142,196

[45] Date of Patent: Aug. 25, 1992

[54] GAS DISCHARGE ELECTRODES

[75] Inventor: Neil A. Fox, Eversham, England

[73] Assignee: Smiths Industries Public Limited Company, London, United Kingdom

[21] Appl. No.: 667,868

[22] Filed: Mar. 12, 1991

[30] Foreign Application Priority Data

Mar. 31, 1990 [GB] United Kingdom ..... 9007327

[51] Int. Cl.[5] ..... H01J 61/04

[52] U.S. Cl. ..... 313/631; 313/632; 313/574

[58] Field of Search ..... 313/631, 632, 621, 574

[56] References Cited

U.S. PATENT DOCUMENTS

| | | | |
|---|---|---|---|
| 2,449,113 | 9/1948 | Fruth | 313/631 |
| 2,534,762 | 12/1950 | Epstein | 313/631 |
| 3,248,586 | 4/1966 | Schlegel | 313/632 |
| 4,767,965 | 8/1988 | Yamano et al. | 313/491 |

FOREIGN PATENT DOCUMENTS

| | | |
|---|---|---|
| 8800758 | 1/1988 | PCT Int'l Appl. . |
| 8912905 | 12/1989 | PCT Int'l Appl. . |
| 9009676 | 8/1990 | PCT Int'l Appl. . |
| 326532 | 3/1930 | United Kingdom . |
| 340936 | 12/1930 | United Kingdom . |
| 359054 | 10/1931 | United Kingdom . |
| 384857 | 12/1932 | United Kingdom . |
| 701589 | 12/1953 | United Kingdom . |
| 714842 | 9/1954 | United Kingdom . |
| 1586676 | 3/1981 | United Kingdom . |

OTHER PUBLICATIONS

Soviet Inventions Illustrated, Week 8350, p. 13 SU 1001225, Feb. 1, 1984.

Patent Abstracts of Japan, vol. 13, No. 496, p. 110, E 843, No. 1200548, Nov. 9, 1989.

*Primary Examiner*—Donald J. Yusko

*Assistant Examiner*—Diab Hamadi

*Attorney, Agent, or Firm*—Pollock, Vande Sande and Priddy

[57] ABSTRACT

An electrode for a cold cathode discharge lamp, has several parallel recesses extending across the width of the electrode and at an angle of about 35 degrees away from the normal to its surface. The electrode may be formed by folding a strip of metal so that the recesses are formed between adjacent folds of the strip. Alternatively, the electrode may be a block of metal in which the recesses are slots formed in a surface of the block. The electrode may be included in a tubular lamp or in a planar lamp.

8 Claims, 2 Drawing Sheets

GAS DISCHARGE ELECTRODES

BACKGROUND OF THE INVENTION

This invention relates to electrodes for cold cathode discharge lamps.

Conventional gas discharge lamps take one of two forms. They are either of the hot-cathode or cold-cathode kind. In the hot-cathode kind, the electrodes are heated so that electrons are emitted from the cathode by primary emission; in the cold-cathode kind, ion bombardment of the cathode causes the secondary emission of electrons. Although hot-cathode lamps have a greater electrical efficiency, cold-cathode lamps have the advantage of a considerably longer life and maintain a more constant brightness over their life than hot-cathode lamps.

The electrodes of cold-cathode lamps are generally hollow, that is, they take the shape of a short tube having an open end and a closed end, the open end facing the opposite electrode. Electrodes of this shape have been found to produce a more stable discharge and require lower operating voltages than flat plate electrodes.

BRIEF SUMMARY OF THE INVENTION

It is an object of the present invention to provide an improved electrode for use in a cold cathode lamp.

According to one aspect of the present invention there is provided an electrode for use in a cold cathode discharge lamp, the electrode having a plurality of recesses arranged side-by-side along the electrode such that each recess provides a region of high current density.

The recesses are preferably elongate along a surface of the electrode. The recesses preferably extend across the entire width of the electrode and at an angle away from the normal to the surface of the electrode. The angle may be about 35 degrees. The depth of each recess is preferably between about 5–6 times its width. The electrode may take the form of a folded strip of metal in which the recesses are formed between adjacent folds of the strip on both sides of the strip. The electrode may have approximately six recesses on each side. Alternatively, the electrode may be a block of metal in which the recesses are slots formed in a surface of the block.

According to another aspect of the present invention there is provided a lamp including at least one electrode according to the above-mentioned one-aspect of the invention.

The lamp preferably includes two electrodes. The lamp may have a tubular envelope and an electrode at each end of the envelope. Alternatively, the lamp may be of planar shape, the electrodes extending along opposite sides of the lamp.

Two forms of gas discharge lamp including electrodes, in accordance with the present invention, will now be described, by way of example, with reference to the accompanying drawings.

DESCRIPTION OF THE PREFERRED EMBODIMENTS

Figure 1:
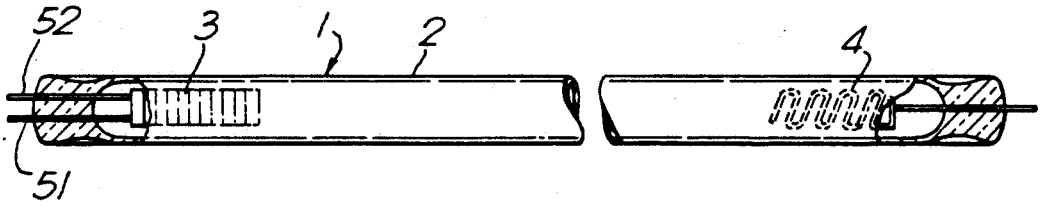
FIG. 1 is a plan view of one form of lamp.

With reference first to FIG. 1, the lamp 1 is of tubular form having a cylindrical glass envelope 2, about 340 mm long, sealed at opposite ends to electrodes 3 and 4 respectively. The envelope 2 is evacuated to low pressure and filled with a conventional gas discharge mixture.

Figure 2:
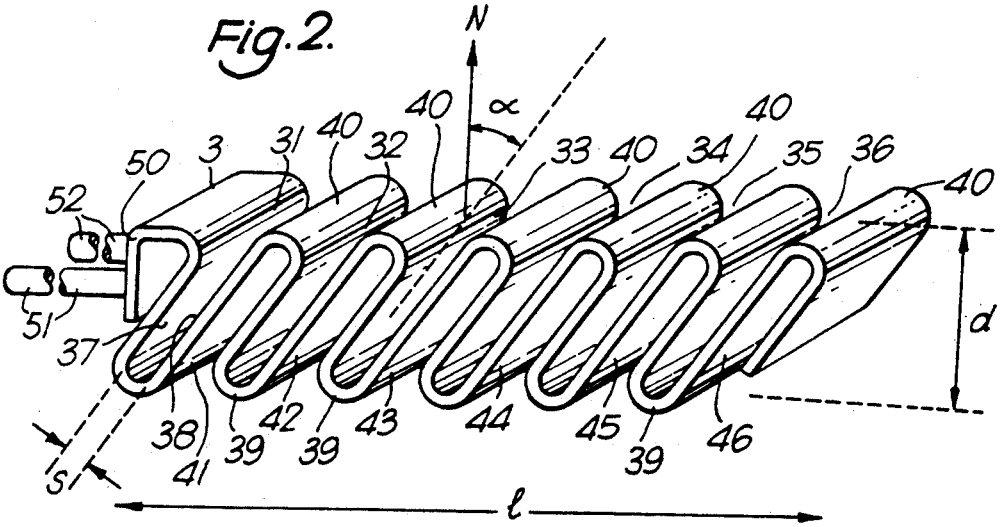
FIG. 2 is a perspective view, to an enlarged scale of one electrode of the lamp of FIG. 1.

The electrodes 3 and 4 are of the same construction, the left-hand electrode 3 being shown more clearly in FIG. 2. The electrode 3 is made from a strip of tantalum or nickel-iron alloy such as NILO 42 which is 7 mm wide, 190 mm long by 0.15 mm thick. The strip is folded about lines extending at right angles across its width into a series of six U-shape recesses 31 to 36 which extend parallel to one another in the upper surface of the electrode. Each recess 31 to 36 has two parallel sides 37 and 38 separated from one another by a width s of 1.1 mm and joined at their lower end by a curved floor portion 39. Adjacent recesses are joined by respective convex intermediate portions 40 of the same size and shape as the floor portions 39 so that the electrode 3 is also provided with a series of six recesses 41 to 46 on its lower surface which are interposed between the recesses 31 to 36 on the upper surface.

The recesses 31 to 36 and 41 to 46 are inclined away from the vertical, that is, the normal N to the surface of the electrode, at an angle $\alpha$ of about 35 degrees. The depth d of the electrode 3 between its upper surface and lower surface is 6.3 mm (so that the depth of the recesses is 5–6 times their width) and its length l is 26.1 mm.

At its rear end, the strip is bent vertically downwards into a rear portion 50. Projecting rearwardly from the rear portion 50 are two rods 51 and 52 made from the same material as the strip. The rods 51 and 52 are of circular section being 1 mm in diameter and 16 mm in length and extend parallel to the axis of the electrode through the left hand sealed end of the envelope 2.

The recesses 31 to 36 and 41 to 46 on opposite sides of the electrode provide twelve separate regions of high current density (compared with that along the surface of the electrode) when a discharge potential is applied between the two electrodes 3 and 4. Because the recesses are arranged transversely of the electrode, it is possible to achieve a gas-discharge of similar characteristics to one that is produced by a conventional tubular electrode but with a shorter axial length. By inclining the recesses away from the normal they can be longer than would otherwise be the case. This has the advantage that the dead space at the ends of the tube, over which the level of illumination is low, can be shorter than in lamps with conventional electrodes. Where tubular discharge lamps are used to provide back lighting of displays, it is often desirable to produce a display that is evenly illuminated over as large an area as possible but without wasting space at the edge of the display. To achieve this, it is conventional practice to bend the ends of the tube backwards so that the dead space at the ends of the tube is accommodated within the depth of the display. This can also be done with the tube of the present invention, with the advantage that the length of tube that requires to be bent back is minimized and, therefore, that the increase in the depth of the display is minimized. This can be a significant advantage where space is limited such as in aircraft instrumentation.

In the lamp shown in FIG. 1, the right hand electrode 4 is rotated through 90 degrees about its axis relative to the left-hand electrode 3.

The electrode 3 can be manufactured simply by bending the flat strip of nickel-iron alloy on a jig. It will be appreciated that the electrode will be thoroughly degreased before being assembled in the tube and vacuum cleaned before admittance of the gas discharge mixture.

In general, gas discharge lamps are operated in an a c mode so that the two electrodes alternate between being a cathode and anode. For this reason, it is preferable for both electrodes to be of the kind according to the present invention. Where, however, the discharge lamp is operated in a d c mode, only one of the electrodes, the cathode, need be of the present invention.

Figure 3:
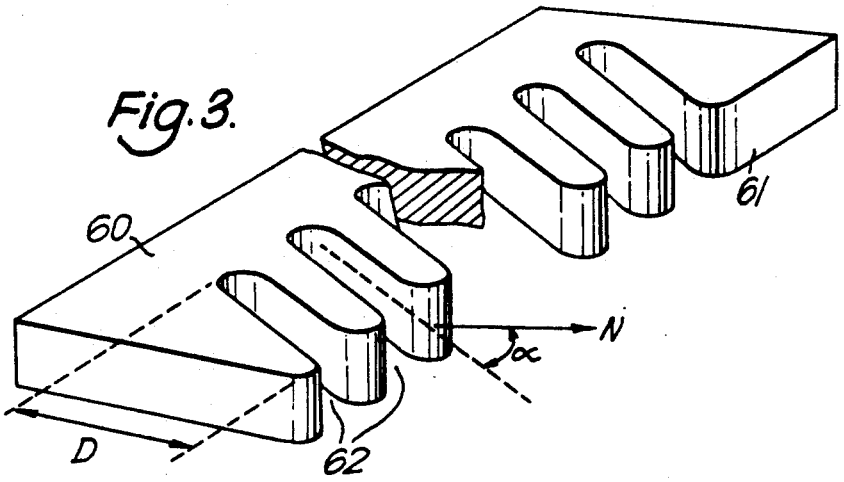
FIG. 3 is a perspective view of an alternative electrode in an alternative lamp.
Figure 4:
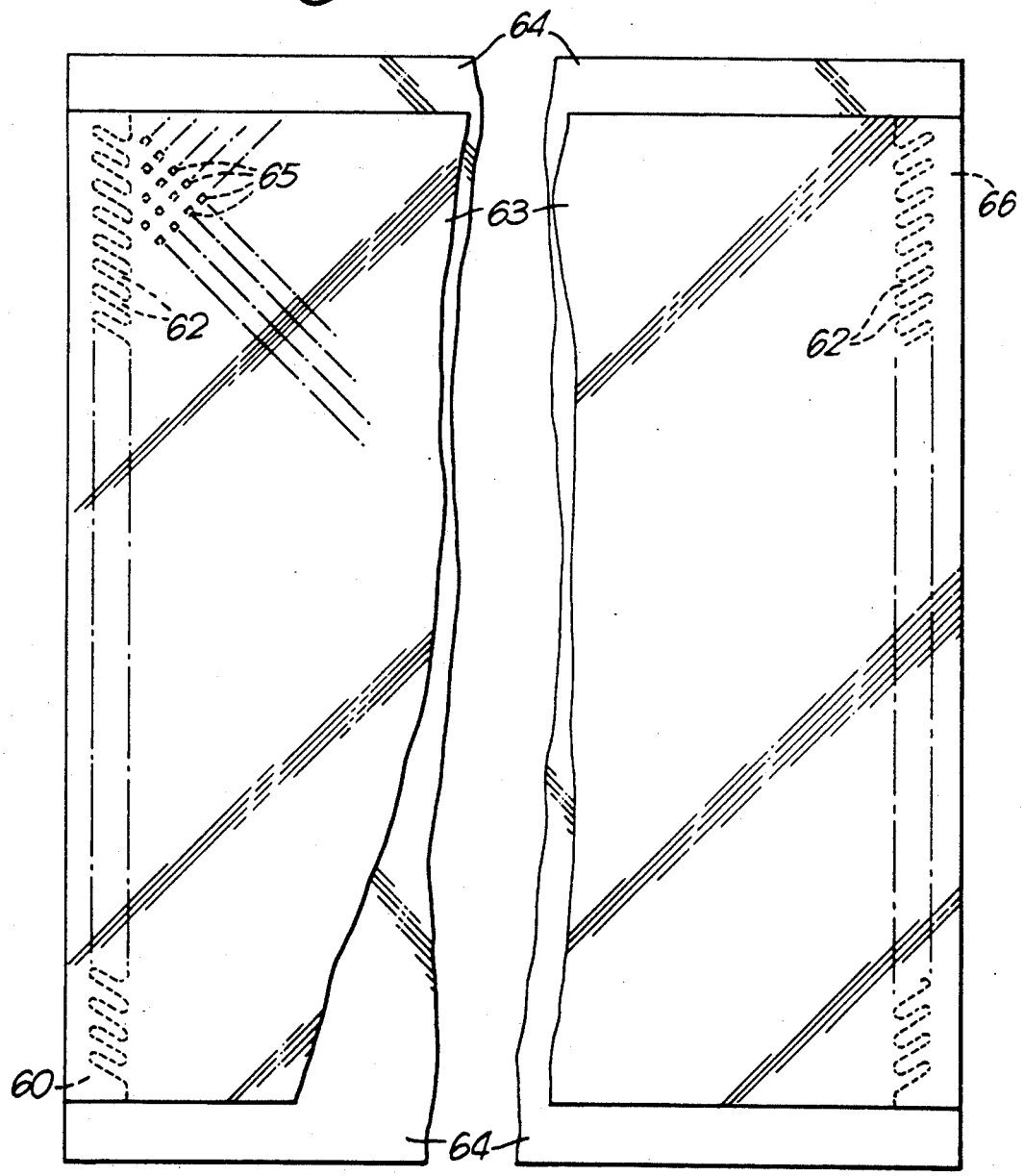
FIG. 4 is a plan view of the alternative lamp.

Another form of the invention is shown in FIGS. 3 and 4. In this form, the electrode 60 is a rectangular block of nickel-iron alloy such as NILO 42. The block is 160 mm long, 0.866 mm wide and 10 mm deep. On its front surface 61, the electrode 60 has an array of forty-one vertical slots 62 providing individual recesses. Each slot is 1.1 mm wide and extends into the block at an angle $\alpha$ of 35 degrees to the normal N to the front surface 61. The depth D of each slot is about 6 mm and the separation between adjacent slots is about 2.1 mm.

This electrode 60 is incorporated in the left-hand end of a flat panel type of discharge lamp 64, such as of the kind described in WO 90/09676. The electrode 60 extends along one side edge of the lamp with the slot recesses 62 exposed to the discharge gas between upper and lower glass plates 63 and 64. The two plates 63 and 64 are spaced from one another by an array of support pillars 65 distributed over the surface of the plates. At the opposite end of the lamp, there is an identical electrode 66, the slots of which are aligned in the opposite sense to the slots in the left-hand electrode 60.

This form of electrode configuration has been found to be particularly advantageous in flat panel discharge lamps because it generates a distributed negative glow over a long length of electrode surface leading to a very even illumination over the surface of the lamp.

The electrodes 3, 4, 60 and 66 may be coated, in the usual way, such as with an alkaline-earth metal oxide, to increase electron emission.

What I claim is:

1. In a cold cathode discharge lamp of the kind comprising an envelope of planar shape filled with a discharge gas and having first and second electrodes at opposite ends of the envelope separated by the discharge gas, the improvement wherein at least one of the electrodes extends laterally along a side of the envelope and has a plurality of recesses arranged side-by-side along the electrode and extending across the width of the electrode such that each recess provides a region of high current density.

2. A lamp according to claim 1 wherein the electrode is a block of metal, and wherein the recesses are parallel slots machined into a surface of the block.

3. A lamp according to claim 1, wherein the recesses extend at an angle away from the normal to the surface of the electrode.

4. A lamp according to claim 3, wherein the said angle is about 35 degrees.

5. In a cold cathode discharge lamp of the kind comprising an envelope of tubular shape filled with a discharge gas and having first and second electrodes at opposite ends of the envelope separated by the discharge gas, the improvement wherein at least one of the electrodes comprises an elongated strip of metal folded across its width several times to form a plurality of recesses between adjacent folds of the strip on both sides of the strip, said electrode extending parallel to the axis of the lamp and the recesses extending transversely with each recess providing a region of high current density.

6. A lamp according to claim 1 or 5, wherein the depth of each recess is between about 5–6 times its width.

7. A lamp according to claim 1 or 5 wherein both electrodes are substantially identical.

8. A lamp according to claim 4 wherein the recesses in the two electrodes are inclined with respect to one another.

* * * * *